US011360425B2

(12) United States Patent
Kannari et al.

(10) Patent No.: US 11,360,425 B2
(45) Date of Patent: Jun. 14, 2022

(54) IMAGE FORMING APPARATUS AND SHEET STORING APPARATUS

(71) Applicant: CANON KABUSHIKI KAISHA, Tokyo (JP)

(72) Inventors: Isao Kannari, Saitama (JP); Hajime Sekiguchi, Chiba (JP); Keitaro Taoka, Chiba (JP); Hiroyuki Nakagawa, Chiba (JP); Misaki Shiozawa, Chiba (JP); Kouyou Tamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/318,702

(22) Filed: May 12, 2021

(65) Prior Publication Data

US 2021/0373485 A1 Dec. 2, 2021

(30) Foreign Application Priority Data

May 26, 2020 (JP) ..... JP2020-091344

(51) Int. Cl.

| | |
|---|---|
| ***G03G 21/16*** | (2006.01) |
| ***G03G 15/00*** | (2006.01) |
| ***B65H 1/26*** | (2006.01) |
| ***B65H 1/02*** | (2006.01) |

(52) U.S. Cl.

CPC ..... *G03G 21/1647* (2013.01); *B65H 1/027* (2013.01); *G03G 15/6502* (2013.01); *G03G 21/1695* (2013.01)

(58) Field of Classification Search

CPC ..... G03G 15/6502; G03G 15/6505; G03G 21/1647; G03G 21/1695; G03G 2215/00383; G03G 2215/0097; B65H 1/027; B65H 1/266

See application file for complete search history.

(56) References Cited

U.S. PATENT DOCUMENTS

| | | | | |
|---|---|---|---|---|
| 2017/0308029 | A1* | 10/2017 | Soda | B65H 1/266 |
| 2019/0077619 | A1* | 3/2019 | Umezawa | B65H 1/266 |
| 2019/0300305 | A1* | 10/2019 | Nakanosono | G03G 21/1647 |
| 2021/0300695 | A1* | 9/2021 | Katafuchi | B65H 1/266 |

FOREIGN PATENT DOCUMENTS

| | | |
|---|---|---|
| JP | H08-157080 | 6/1996 |

* cited by examiner

*Primary Examiner* — Sophia S Chen
(74) *Attorney, Agent, or Firm* — Venable LLP

(57) ABSTRACT

An image forming apparatus includes a cassette, an image forming unit configured to form an image on a sheet fed from the cassette a set position, a guide rail configured to draw out the cassette from the set position, and a movable stopper unit that regulates a movement of the cassette in a draw-out direction by abutting with the cassette while the cassette is drawn out from the set position along the guide rail. The movable stopper unit includes a regulating portion movable between a regulating position where the regulating portion regulates a movement of the cassette within a moving trajectory of the cassette in moving in the draw-out direction and a retracting position where the regulating portion is located outside of the moving trajectory and does not regulate the movement of the cassette, and an urging portion configured to urge the regulating portion to the regulating position.

9 Claims, 4 Drawing Sheets

IMAGE FORMING APPARATUS AND SHEET STORING APPARATUS

BACKGROUND OF THE INVENTION

Field of the Invention

The present invention relates to an image forming apparatus configured to form an image onto a sheet fed from a cassette, and a sheet storing apparatus.

Description of the Related Art

Hitherto, there is proposed a copier provided with a drawout-and-fall preventing unit configured such that a sheet feed tray does not fall by being drawn out of an apparatus body as disclosed in Japanese patent application laid-open. No. H08-157080. The drawout-and-fall preventing unit includes a screw that is screwed into a tapped hole perforated through a slide rail and a projection formed on the sheet feed tray and is capable of abutting with the screw. The screw is capable of moving between a normal position where the screw abuts with the projection of the sheet feed tray and a release position where the screw is retracted such that the screw does not come into contact with the projection of the sheet feed tray. When the sheet feed tray is to be taken out, the screw is moved to the release position by a tool such as a screw driver.

The sheet feed tray is also provided with a rib that is abuttable with the screw positioned at the release position to prevent a user from forgetting to return the screw from the release position to the normal position by abutting with the screw positioned at the release position when the sheet feed tray having been once taken out is set to a set position.

However, the screw described in Japanese patent application laid-open. No. H08-157080 needs to be manipulated by the user by the tool and has a problem in terms of operability. Still further, the user needs to purposely move the screw from the release position to the normal position in setting the sheet feed tray, having another problem in terms of operability.

SUMMARY OF THE INVENTION

According to a first aspect of the present invention, an image forming apparatus includes a cassette configured to store sheets, an image forming unit configured to form an image on the sheet fed from the cassette located at a set position, a guide rail configured to support the cassette to draw out the cassette from the set position to replenish sheets, and a movable stopper unit that regulates a movement of the cassette in a draw-out direction by abutting with the cassette while the cassette is drawn out from the set position along the guide rail. The movable stopper unit includes a regulating portion movable between a regulating position where the regulating portion regulates a movement of the cassette within a moving trajectory of the cassette in moving in the draw-out direction and a retracting position where the regulating portion is located outside of the moving trajectory and does not regulate the movement of the cassette, and an urging portion configured to urge the regulating portion to the regulating position.

According to a second aspect of the present invention, a sheet storing apparatus includes an apparatus body, a cassette configured to be drawn out of and attached to the apparatus body and configured to store sheets, a guide rail configured to support the cassette to draw out the cassette located at a set position to replenish sheets, and a movable stopper unit that regulates a movement of the cassette in a draw-out direction by abutting with the cassette while the cassette is drawn out from the set position along the guide rail. The movable stopper unit includes a regulating portion movable between a regulating position where the regulating portion regulates the movement of the cassette within a moving trajectory of the cassette in moving in the draw-out direction and a retracting position where the regulating portion is located outside of the moving trajectory and does not regulate the movement of the cassette, and an urging portion configured to urge the regulating portion to the regulating position.

Further features of the present invention will become apparent from the following description of exemplary embodiments with reference to the attached drawings.

DESCRIPTION OF THE EMBODIMENTS

An image forming apparatus of the present disclosure will be described below with reference to the drawings. Note that as for dimensions, materials, shapes and relative dispositions of component parts described in the following exemplary embodiment, applicable ranges of the technology of the present disclosure are not limited only to them unless specially specified.

Schematic Configuration of Printer

Figure 1:
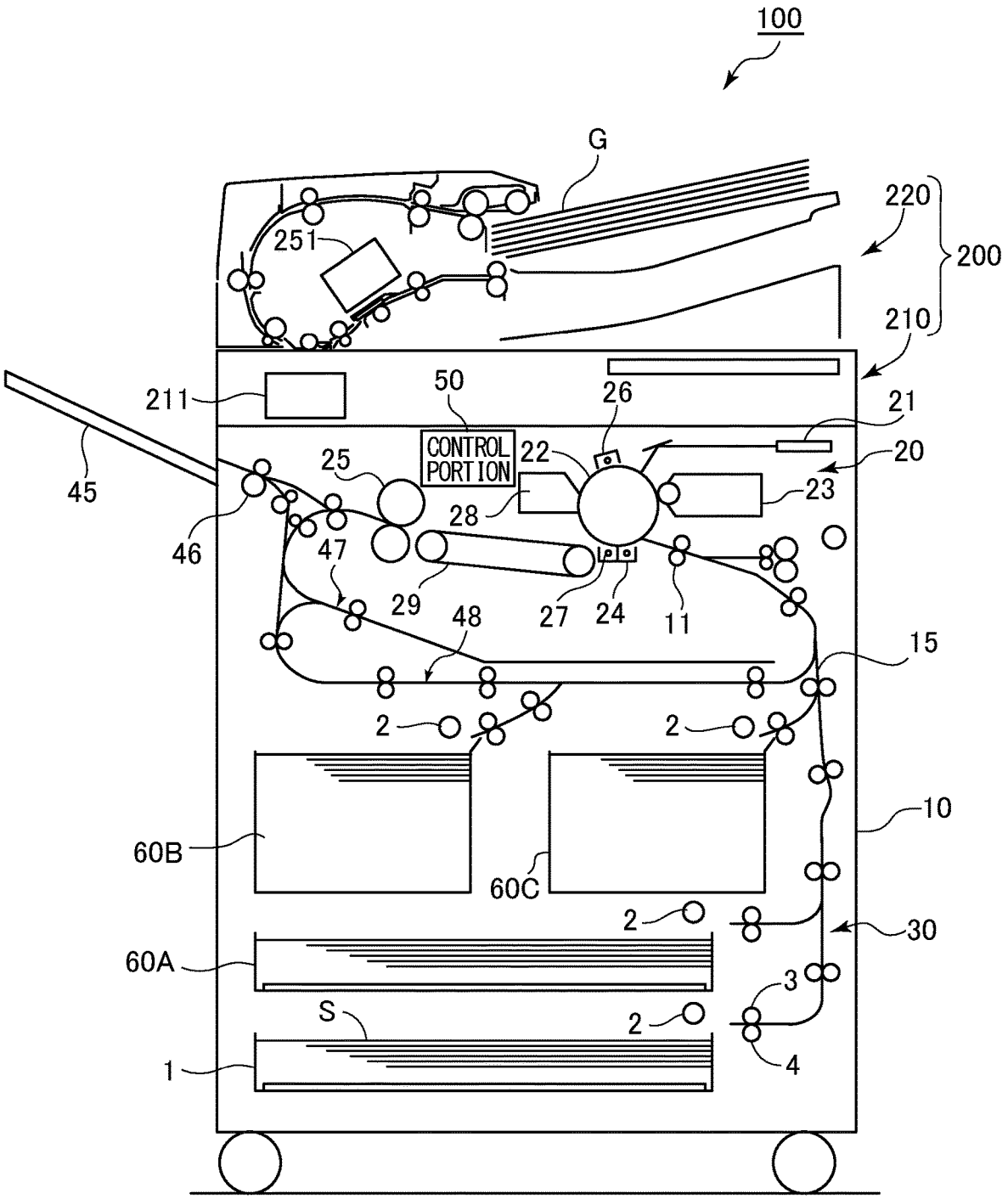
FIG. 1 is a schematic diagram illustrating a whole configuration of a printer of an exemplary embodiment.

Firstly, a schematic configuration of a printer 100 serving as the image forming apparatus will be described with reference to FIG. 1. As illustrated in FIG. 1, the printer 100 includes a printer body 10 and an image reading apparatus 200.

The image reading apparatus 200 disposed above the printer body 10 includes a reading unit 210 and an automatic document feeder (ADF) 220. The reading unit 210 and the ADF 220 include a first reading portion 211 and a second reading portion 251, respectively. The first reading portion 211 is configured to read an image on a first surface of a document G in a document feeding reading operation or in a document fixed reading operation. The second reading portion 251 is configured to read an image of a second surface of the documents G in the document feeding reading operation. Note that the sheet of the present exemplary embodiment includes a sheet of paper such as a plain sheet and an envelope, a plastic film such as an overhead projector sheet (OHP) and a cloth. The document G is also contained in the sheet of the present exemplary embodiment. Image information transformed into electrical signals by the image reading apparatus 200 is transferred to a control portion 50 provided in the printer body 10.

The printer body 10 includes an image forming unit 20 configured to form an image on a sheet S serving as a recording medium, a sheet feed unit 30 configured to feed the sheet S to the image forming unit 20 and a fixing unit 25. The sheet feed unit 30 serving as a sheet storing apparatus includes sheet stacking portions 1, 60A, 60B and 60C capable of storing sheets having different sizes from each other. The sheet stored in each sheet stacking portion is delivered out of the sheet stacking portion by a pickup roller 2 serving as the sheet feeding unit and is conveyed while being separated one by one by a feed roller 3 and a retard roller 4.

Then, the sheet S is conveyed to a registration roller pair 11 while being sequentially passed by a plurality of conveyance roller pairs disposed along a sheet conveyance path 15. The registration roller pair 11 is configured to correct a skew of the sheet S by stopping a leading edge of the sheet S and to restart the conveyance of the sheet S by adjusting with a progress of an imaging operation which is a toner image forming process of the image forming unit 20.

The image forming unit 20 configured to form an image onto the sheet S is an electro-photographic image forming unit provided with a photosensitive drum 22 serving as a photosensitive member. The photosensitive drum 22 is rotatable along the conveyance direction of the sheet S. A charger 26, an exposing unit 21, a developer 23, a transfer charger 24, a separation charger 27 and a cleaner 28 are disposed around the photosensitive drum 22. The charger 26 homogeneously electrifies a surface of the photosensitive drum 22 and the exposing unit 21 exposes the photosensitive drum 22 based on image information inputted from the image reading apparatus 200 or the like to form an electrostatic latent image on the surface of the photosensitive drum 22.

The developer 23 stores two-component developer containing toner and carrier and develops the electrostatic latent image as a toner image by supplying the electrified toner to the photosensitive drum 22. The toner image borne on the photosensitive drum 22 is transferred onto the sheet S conveyed from the registration roller pair 11 by a bias electric field formed by the transfer charger 24. The sheet S onto which the toner image has been transferred is separated from the photosensitive drum 22 by the bias electric field formed by the separation charger 27 and is conveyed toward the fixing unit 25 by a fixing pre-conveyance portion 29. Note that adhesives such as transfer residual toner left on the photosensitive drum 22 without being transferred onto the sheet S is removed by the cleaner 28 to be ready for a next image forming operation of the photosensitive drum 22.

The sheet S conveyed to the fixing unit 25 is heated while being nipped and pressurized by a roller pair such that the toner image is fixed onto the sheet S by melting and securing the toner. In a case where an output operation of the image is being completed, the sheet S onto which the image has been fixed is discharged to a discharge tray 45 projecting out of the printer body 10 through a discharge roller pair 46. In a case where an image is to be formed on a back surface of the sheet S in a duplex printing, the sheet S that has passed through the fixing unit 25 is reversed by a reverse portion 47 and is conveyed to the registration roller pair 11 by a duplex conveyance portion 48. Then, the sheet S onto which the other image has been formed again by the image forming unit 20 is conveyed to a discharge tray 45.

Sheet Feed Unit

Next, the sheet feed unit 30 will be described in detail. Note that while the following description will be made by exemplifying the sheet stacking portion 1 composed of a cassette and its peripheral components, the other sheet stacking portions 60A, 60B and 60C also have a similar configuration with the sheet stacking portion 1.

Figure 2:
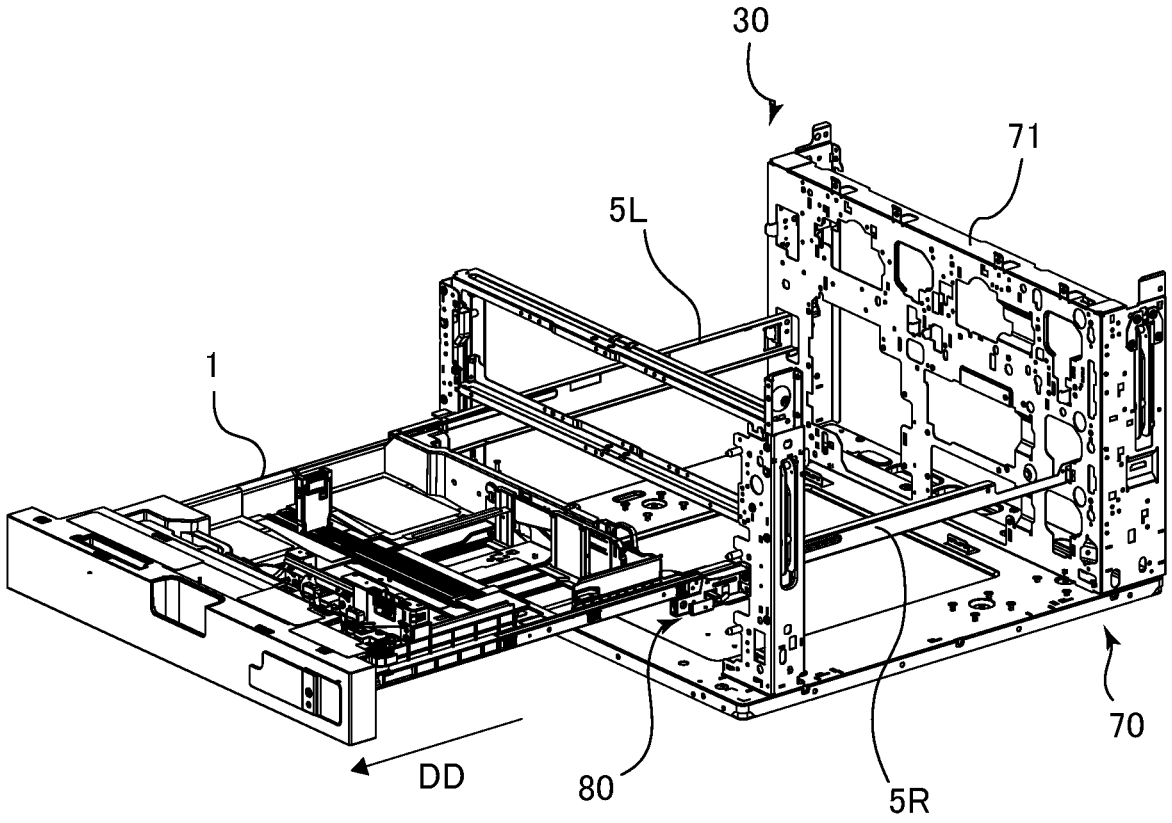
FIG. 2 is a perspective view illustrating a sheet feed tray.

As illustrated in FIG. 2, the sheet feed unit 30 includes an apparatus body 70 and the sheet stacking portion 1 provided drawably out of and attachably to the apparatus body 70 and configured to stack the sheets S. The apparatus body 70 includes a casing frame 71 and guide rails 5L and 5R serving as a guide portion fixed to the casing frame 71. The guide rails 5L and 5R guide the sheet stacking portion 1 in a draw-out direction DD.

The guide rail 5L is provided with a fixed stopper not illustrated and the guide rail 5R is provided with a movable stopper unit 80 serving as a regulating unit. A movement of the sheet stacking portion 1 in the draw-out direction DD is regulated as the sheet stacking portion 1 abuts with the fixed stopper and the movable stopper unit 80 while the sheet stacking portion 1 is drawn out of the apparatus body 70. This arrangement makes it possible to prevent the sheet stacking portion 1 from falling down. Note that it is possible to replenish sheets S to the sheet stacking portion 1 at a sheet replenishing position where the sheet stacking portion 1 abuts with the fixed stopper and the movable stopper unit 80.

Configuration of Movable Stopper Unit

Figure 3:
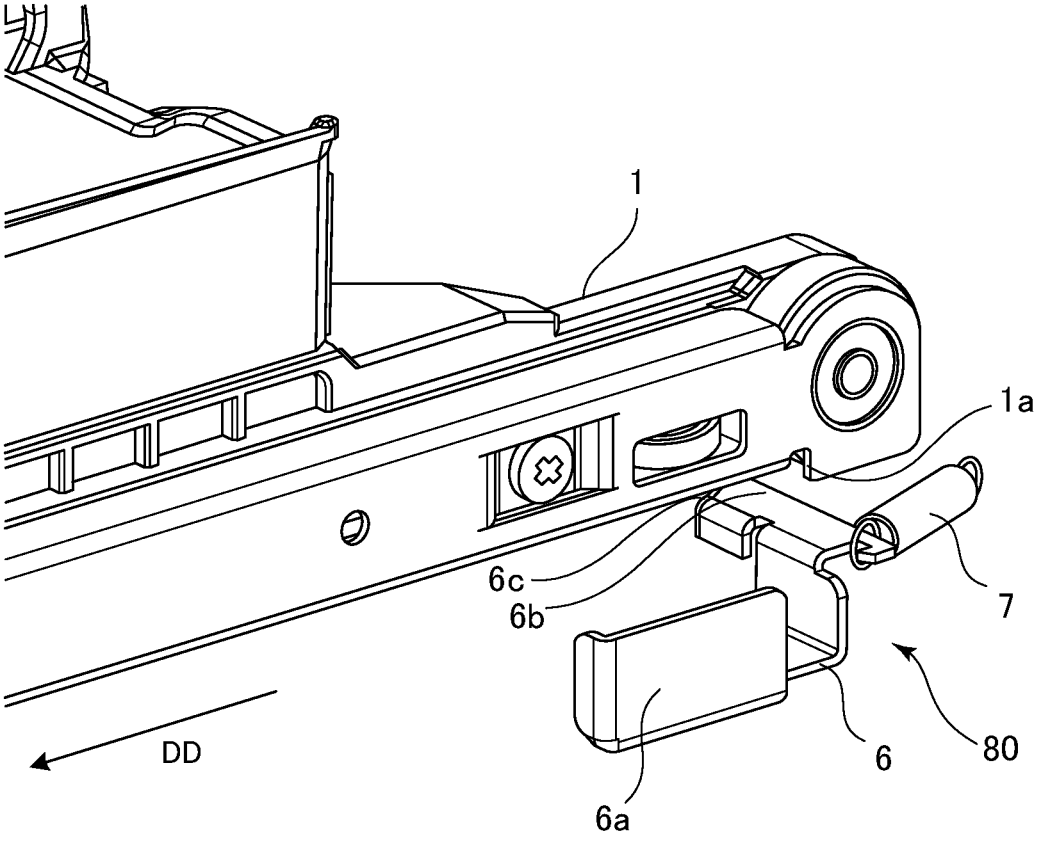
FIG. 3 is a perspective view illustrating a movable stopper unit.
Figure 4A:
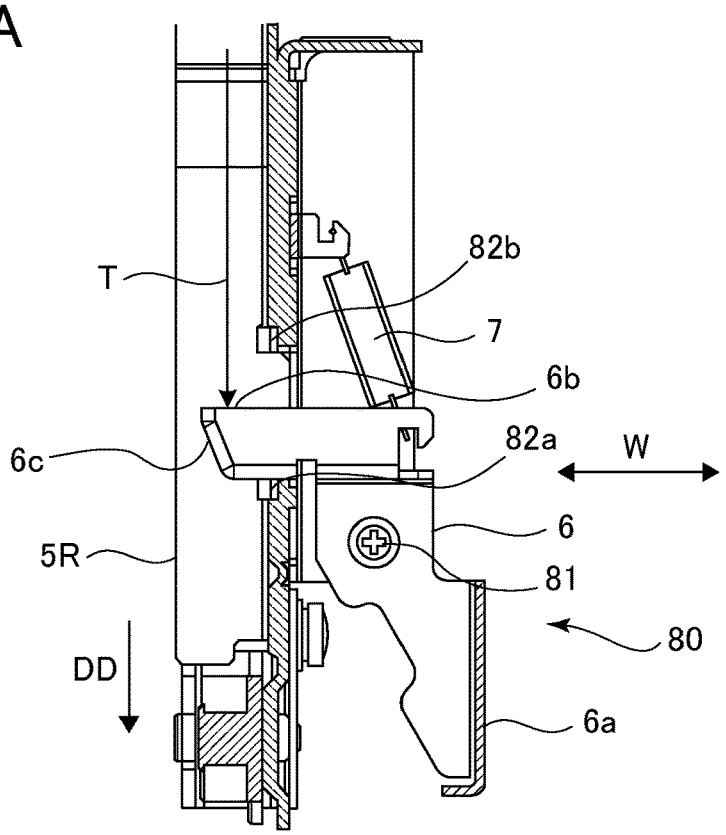
FIG. 4A is a plan view illustrating the movable stopper unit located at a regulating position.
Figure 4B:
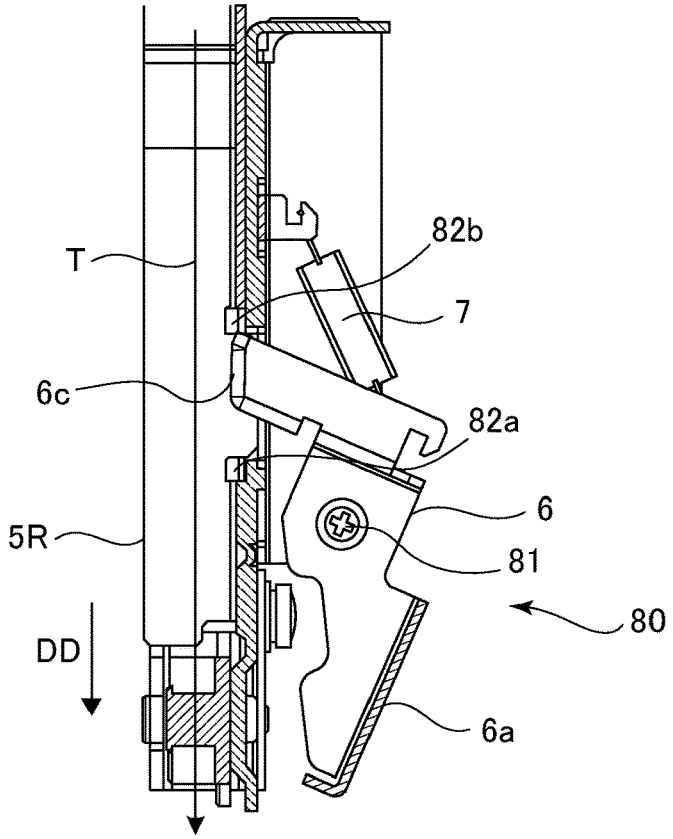
FIG. 4B is a plan view illustrating the movable stopper unit located at a retracting position.

Next, a configuration of the movable stopper unit 80 will be described in detail with reference to FIGS. 3 through 4B. As illustrated in FIGS. 3 through 4B, the movable stopper unit 80 includes a movable stopper 6 pivotably supported centering on a pivot shaft 81 and a spring 7 serving as an urging portion. The movable stopper 6 serving as a regulating portion is movable between a regulating position as illustrated in FIG. 4A and a retracting position as illustrated in FIG. 4B and is urged toward the regulating position. As illustrated in FIG. 4A, the regulating position is a position where the movable stopper 6 overlaps with a moving trajectory T when the sheet stacking portion 1 moves in the draw-out direction DD. The retracting position is a position where the movable stopper 6 does not overlap with the moving trajectory T as illustrated in FIG. 4B.

The guide rail 5R is provided with first and second stoppers 82*a* and 82*b*, and the movable stopper 6 urged by the spring 7 is positioned at the regulating position by abutting with the first stopper 82*a* serving as a stopper. The movable stopper 6 pivots from the regulating position to the retracting position against the urging force of the spring 7 as the user pivotally manipulates an operating portion 6*a* of the movable stopper 6. The movable stopper 6 abuts with the second stopper 82*b* when the movable stopper 6 is positioned at the retracting position. Therefore, the user can readily recognize that the movable stopper 6 has arrived at the retracting position in manipulating the operating portion 6*a* and can hold the movable stopper 6 stably at the retracting position.

The movable stopper 6 includes a butting portion 6*b* that can abut with an abutment portion 1*a* of the sheet stacking portion 1 and an inclined surface 6*c*. The inclined surface 6*c* is inclined with respect to the draw-out direction DD in a state in which the movable stopper 6 is positioned at the regulating position. More specifically, the more the inclined surface 6*c* extends downstream in the draw-out direction DD, the more the inclined surface 6*c* extends toward an outside of the sheet feed unit 30 in a width direction W orthogonal to the draw-out direction DD.

Operation of Movable Stopper Unit

Next, an operation of the movable stopper unit 80 will be described with reference to FIGS. 4A and 4B. Firstly, an operation of drawing out the sheet stacking portion 1 to the sheet replenishing position without taking out of the apparatus body 70 will be described. In this operation, the user draws the sheet stacking portion 1 out of the apparatus body 70 without manipulating the operating portion 6*a* of the movable stopper 6.

The movable stopper 6 is positioned at the regulating position by the spring 7 as illustrated in FIG. 4A when the operating portion 6*a* of the movable stopper 6 is not manipulated. Even if the sheet stacking portion 1 is tried to be drawn out of the apparatus body 70 in this state, the butting portion 6*c* butts with the abutment portion 1*a* of the sheet stacking portion 1, because the butting portion 6*c* of the movable stopper 6 overlaps with the moving trajectory T of the sheet stacking portion 1. Thereby, the sheet stacking portion 1 comes to stop at the sheet replenishing position and is prevented from falling out of the apparatus body 70.

Next, an operation of taking the sheet stacking portion 1 out of the apparatus body 70 will be described. In this operation, the user draws the sheet stacking portion 1 out of the apparatus body 70 while manipulating the operating portion 6*a* of the movable stopper 6.

When the user pivotally manipulates the operating portion 6*a* of the movable stopper 6, the movable stopper 6 is held at the retracting position against the urging force of the spring 7 as illustrated in FIG. 4B. If the sheet stacking portion 1 is drawn out of the apparatus body 70 in this state, the movable stopper 6 will not interfere the movement of the sheet stacking portion 1 in the draw-out direction DD because the movable stopper 6 retracts from the moving trajectory T of the sheet stacking portion 1. Therefore, the sheet stacking portion 1 can be readily taken out of the apparatus body 70. Note that it is possible to release an engagement of the fixed stopper provided on the left guide rail 5L with the sheet stacking portion 1 by moving the sheet stacking portion 1 in a right side of the apparatus after drawing out the sheet stacking portion 1 by passing through the movable stopper 6.

When the user finishes to manipulate the operating portion 6*a* of the movable stopper 6 after taking the sheet stacking portion 1 out of the apparatus body 70, the movable stopper 6 is positioned again at the regulating position by the urging force of the spring 7. It is possible to exchange internal parts such as the pickup roller 2 in the state in which the sheet stacking portion 1 is taken out of the apparatus body 70.

Finally, an operation of setting the sheet stacking portion 1 again to the apparatus body 70 from the state in which the sheet stacking portion 1 is taken out of the apparatus body 70 will be described with reference to FIGS. 4A and 4B. In this operation, the user sets the sheet stacking portion 1 to the guide rail 5R after setting the sheet stacking portion 1 by riding over the fixed stopper on the guide rail 5L.

Then, the user inserts the sheet stacking portion 1 into the apparatus body 70 without manipulating the operating portion 6*a* of the operating portion 6. At this time, the movable stopper 6 is located at the regulating position because the operating portion 6*a* is not manipulated. As the sheet stacking portion 1 is inserted into the apparatus body 70, the inclined surface 6*c* of the movable stopper 6 is pressed by the sheet stacking portion 1 and the movable stopper 6 pivots from the regulating position to the retracting position centering on the pivot shaft 81 while resisting against the urging force of the spring 7.

Then, the sheet stacking portion 1 is inserted into the apparatus body 70 while being in sliding-contact with the inclined surface 6*c* in the state in which the movable stopper 6 is held at the retracting position. Note that the inclined surface 6*c* extends at this time in a direction along the draw-out direction DD as illustrated in FIG. 4B. That is, the inclined surface 6*c* extends in the direction along the draw-out direction DD at the retracting position. This arrangement makes it possible to set the sheet stacking portion 1 to the apparatus body 70 smoothly without being caught by the movable stopper 6. When the inclined surface 6*c* overrides the contact portions of the sheet stacking portion 1, the movable stopper 6 returns to the regulating position by the urging force of the spring 7.

Note that it is possible to make this operation while manipulating the operating portion 6*a* of the movable stopper 6. In this case, the sheet stacking portion 1 is inserted into the apparatus body 70 in a state in which the movable stopper 6 is manipulated by the user so as to pivot to the retracting position. Therefore, the sheet stacking portion 1 is set in the apparatus body 7 without contacting with the movable stopper 6.

The arrangement described above makes it possible to move the movable stopper 6 by the simple manipulation of the user without any tool in moving the movable stopper 6 from the regulating position to the retracting position. Still further, in a case where the movable stopper 6 has moved to the retracting position, the movable stopper 6 automatically returns from the retracting position to the regulating position by the urging force of the spring 7 just by finishing the manipulation of the movable stopper 6. Therefore, it is not necessary to purposely manipulate the movable stopper 6 so as to move from the retracting position to the regulating position. Accordingly, it is possible to improve operability in manipulating the movable stopper 6 along the insert and drawing operation of the sheet stacking portion 1.

Still further, in a case of inserting the sheet stacking portion 1 again into the apparatus body 70 after taking the sheet stacking portion 1 out of the apparatus body 70, it is possible to set the sheet stacking portion 1 in the apparatus body 70 just by inserting the sheet stacking portion 1 into the apparatus body 70 without manipulating the movable stopper 6. Due to that, it is possible to eliminate such a case that the user forgets to return the movable stopper 6 from the retracting position to the regulating position and to improve usability.

Other Exemplary Embodiment

Note that while the movable stopper unit 80 is disposed along the right guide rail 5R and the fixed stopper is disposed on the left guide rail 5L in the exemplary embodiment described above, the present disclosure is not limited to such configuration. For instance, the movable stopper unit 80 may be disposed along the guide rail 5L and the fixed stopper may be disposed along the guide rail 5R. The movable stopper units 80 may be also disposed along the right and left guide rails 5R and 5L.

Still further, while the exemplary embodiment described above has been described by exemplifying the movable stopper unit 80 that regulates drawing of the sheet stacking portion 1, the present disclosure is not limited to such configuration. For instance, another movable stopper unit 80 that regulates drawing of the sheet stacking portions 60A, 60B and 60C may be provided. The present disclosure may be applied not only to the cassette storing the sheet to be fed but also to a large volume deck storing sheets and to a discharge sheet stacking portion into which discharged sheets are stored.

Still further, while the movable stopper 6 is provided to be pivotable in the exemplary embodiment described above, the present disclosure is not limited to such configuration. For instance, the movable stopper 6 may be provided to be slidingly movable between the regulating position and the retracting position. The spring 7 is not also limited to be a coil spring and may be another spring such as a leaf spring and a disc spring.

The inclined surface 6*c* is also provided on the movable stopper 6 in the exemplary embodiment described above, the present disclosure is not limited to such configuration. It is possible to eliminate the inclined surface 6*c* if the movable stopper 6 moves to the retracting position by being pressed by the sheet stacking portion 1 in inserting the sheet stacking portion 1 into the apparatus body 70.

Still further, while the movable stopper 6 moves from the regulating position to the retracting position by being manipulated by the user or by being pressed by the sheet stacking portion 1 inserted into the apparatus body 70 in the exemplary embodiment described above, the present disclosure is not limited to such configuration. For instance, it is also possible to arrange such that the movable stopper 6 moves from the regulating position to the retracting position by an actuator such as a solenoid.

While the exemplary embodiment has been described by using the electro-photographic printer 100, the present disclosure is not limited such arrangement. For instance, the present disclosure is also applicable to an inkjet type image forming apparatus configured to form an image on a sheet by discharging ink droplets from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-091344, filed May 26, 2020, which is hereby incorporated by reference herein in its entirety.

What is claimed is:

1. An image forming apparatus comprising:

a first unit; and a second unit configured to store sheets, wherein the first unit includes:

an image forming unit configured to form an image on a sheet fed from the second unit located at a set position, a guide rail configured to support the second unit to draw out the second unit with respect to the first unit in a draw-out direction from the set position to replenish sheets, and a regulating unit that regulates a movement of the second unit in the draw-out direction by abutting with the second unit while the second unit is drawn out from the set position along the guide rail, and wherein the regulating unit includes:

a regulating portion movable between a regulating position where the regulating portion regulates a movement of the second unit within a moving trajectory of the second unit in moving in the draw-out direction and a retracting position where the regulating portion is located outside of the moving trajectory and does not regulate the movement of the second unit, and an urging portion configured to urge the regulating portion to the regulating position.

2. The image forming apparatus according to claim 1, wherein the regulating portion is movable from the regulating position to the retracting position against an urging force of the urging portion by being manipulated by a user.

3. The image forming apparatus according to claim 1, wherein the regulating portion is pivotably supported in the first unit between the regulating position and the retracting position centering on a pivot shaft.

4. The image forming apparatus according to claim 1, wherein the guide rail further comprises a stopper configured to position the regulating portion at the regulating position by abutting with the regulating portion urged by the urging portion.

5. The image forming apparatus according to claim 1, wherein the regulating portion includes an inclined surface inclined with respect to the draw-out direction in a state in which the regulating portion is located at the regulating position, and moves from the regulating position to the retracting position in a case where the inclined surface is pressed by the second unit being attached toward the set position.

6. The image forming apparatus according to claim 1, wherein the regulating unit is provided on the guide rail.

7. The image forming apparatus according to claim 1, further comprising a feed roller configured to feed the sheet in the second unit located at the set position, wherein the feed roller is exchanged in a state in which the second unit is taken out from the first unit.

8. The image forming apparatus according to claim 1, wherein the regulating unit regulates the movement of the second unit in a state where the sheets can be replenished to the second unit.

9. A sheet storing apparatus, comprising:

a first unit; and a second unit configured to be drawn out of and attached to the first unit and configured to store sheets, wherein the first unit includes:

a guide rail configured to support the second unit to draw out the second unit, located at a set position, with respect to the first unit in a draw-out direction to replenish sheets, and a regulating unit that regulates a movement of the second unit in the draw-out direction by abutting with the second unit while the second unit is drawn out from the set position along the guide rail, and wherein the regulating unit includes:

a regulating portion movable between a regulating position where the regulating portion regulates the movement of the second unit within a moving trajectory of the second unit in moving in the draw-out direction and a retracting position where the regulating portion is located outside of the moving trajectory and does not regulate the movement of the second unit, and an urging portion configured to urge the regulating portion to the regulating position.

* * * * *